United States Patent [19]

Seki

[11] Patent Number: 4,493,448

[45] Date of Patent: Jan. 15, 1985

[54] APPARATUS FOR ORIENTING AND PLACING A BUTTON FOR ATTACHMENT TO A GARMENT

[75] Inventor: Fumio Seki, Toyama, Japan

[73] Assignee: Yoshida Kogyo K.K., Tokyo, Japan

[21] Appl. No.: 458,544

[22] Filed: Jan. 17, 1983

[51] Int. Cl.[3] ..... A41H 37/10

[52] U.S. Cl. ..... 227/119

[58] Field of Search ..... 227/119, 120, 117, 118, 227/155

[56] References Cited

U.S. PATENT DOCUMENTS

| | | | |
|---|---|---|---|
| 2,878,954 | 3/1959 | Troske | 227/119 X |
| 3,992,765 | 11/1976 | Silverbush et al. | 227/119 X |
| 4,019,666 | 4/1977 | Foults | 227/119 |

*Primary Examiner*—Paul A. Bell

*Attorney, Agent, or Firm*—Hill, Van Santen, Steadman & Simpson

[57] ABSTRACT

An apparatus for orienting and placing a button for attachment to a garment, comprising: a support; a guide mounted or said support and having a guide channel for guiding the button therethrough; a pusher slidably mounted in said guide for pushing the button through and out of said guide channel; a clinching die fixed to said support contiguous to one end of said guide for receiving thereon the button having been pushed out of said guide channel; a finger holder axially slidably and rotatably mounted on said clinching die and having at its upper end a pair of fingers for clamping the button on said clinching die, said finger holder having on its periphery a first gear; a second gear carried by said support and meshing with said first gear; a fluid-pressurized cylinder operatively connected with said second gear for turning the latter through a predetermined angle; and means for adjustably regulating the extent to which said second gear is turned.

6 Claims, 5 Drawing Figures

APPARATUS FOR ORIENTING AND PLACING A BUTTON FOR ATTACHMENT TO A GARMENT

BACKGROUND OF THE INVENTION

1. Field of the Invention

The present invention relates to an apparatus for orienting and placing a button for attachment to a garment.

2. Prior Art

Machines for attaching buttons to a garment are known in which one button and its mating fastener part at a time are delivered from their respective chutes to a coacting punch and die and are then clinched or coupled together by the punch and die with a garment placed therebetween. If the button bears on its obverse side a design, mark or symbol requiring a specified angular position in which the button is to be mounted on a garment, the button must be oriented in such a direction.

U.S. Pat. No. 4,019,666, issued Apr. 26, 1977, discloses a button orienting apparatus which includes a push mechanism for pushing a button to turn or roll the same by a pushing slide in a guide channel until a tab on the reverse side of the button is caught by a pair of claws on a locking lever mounted on the pushing slide. The push mechanism further pushes the button until the latter is placed in a cylindrical gripping head. Then the gripping head with the button therein is turned through a predetermined angle. Such an angular movement of the gripping head is caused by the use of a coacting rack and pinion. The pinion is connected to the gripping head by a coupling such as universal joint, and the rack is reciprocatingly driven by an air-pressurized cylinder.

However, since the gripping head serves as a die when the button and its mating fastener part are clinched to be coupled together, the gripping head would be inadvertently displaced axially and/or circumferentially due to impact by the punch. Although the coupling absorbs such displacement of the gripping head, it is difficult to achieve accurate angular movement of the gripping head because the coupling is subjected to backlash, which increases due to the torque and impact frequently exerted on the coupling. Further, this frequent impact causes the coupling to be distorted at its bearings so that the gripping head cannot be turned for proper orientation. Moreover, the stroke of the rack is relatively large to turn the pinion through a predetermined angle, thus requiring that the stroke of the air-pressurized cylinder be as large as the rack's stroke. Given the relatively large stroke of the rack and thus of the cylinder, it necessarily takes a long time for the orientation of the button, depending on the amount of the stroke.

SUMMARY OF THE INVENTION

According to the present invention, an apparatus for orienting and placing a button for attachment to a garment, comprises: a support; a guide mounted or said support and having a guide channel for guiding the button therethrough; a pusher slidably mounted in said guide for pushing the button through and out of said guide channel; a clinching die fixed to said support contiguous to one end of said guide for receiving thereon the button having been pushed out of said guide channel; a finger holder axially slidably and rotatably mounted on said clinching die and having at its upper end a pair of fingers for clamping the button on said clinching die, said finger holder having on its periphery a first gear; a second gear carried by said support and meshing with said first gear; a fluid-pressurized cylinder operatively connected with said second gear for turning the latter through a predetermined angle; and means for adjustably regulating the extent to which said second gear is turned.

It is an object of the invention to provide a button orienting and placing apparatus in which a button can be turned through a precise angle by the use of a short air-pressurized cylinder, thus enabling accurate and high-speed orientation of the button.

Many other advantages, features and additional objects of the present invention will become manifest to those versed in the art upon making reference to the detailed description and the accompanying drawings in which a preferred embodiment incorporating the principles of the invention is shown by many of illustrative example.

DETAILED DESCRIPTION OF THE PREFERRED EMBODIMENT

Figure 1:
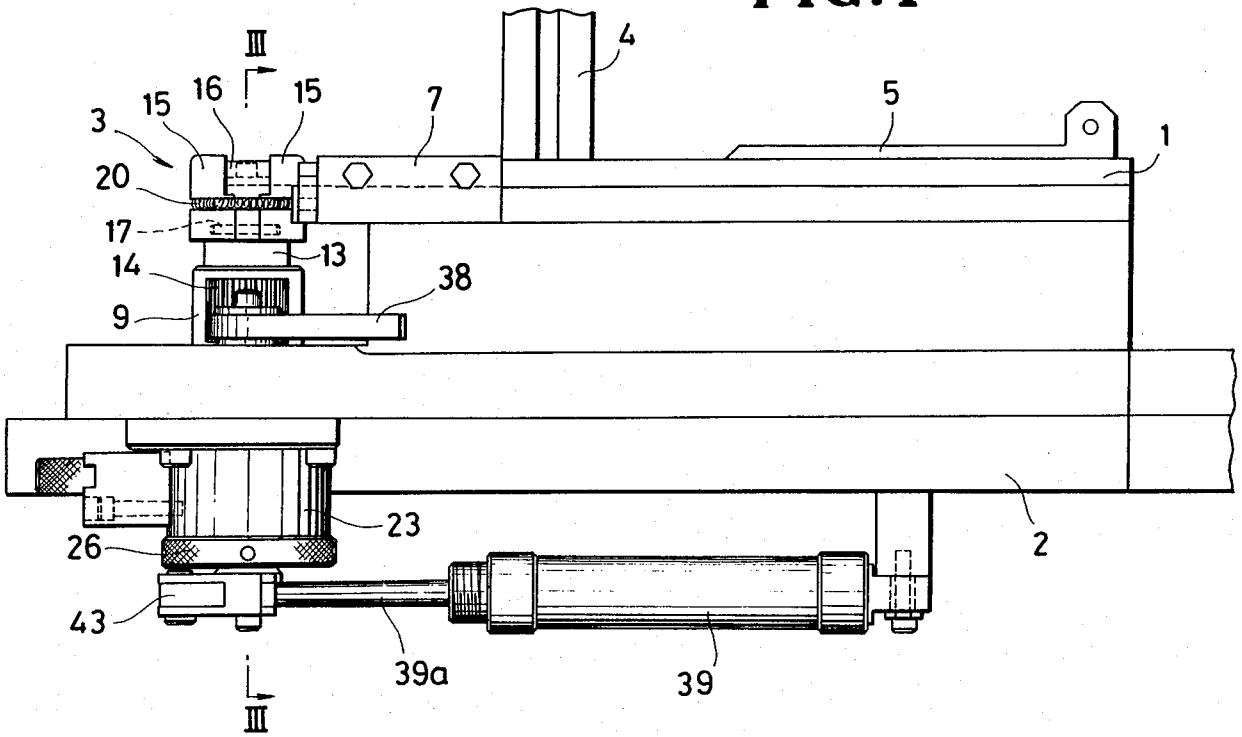
FIG. 1 is a fragmentary front elevational view of a button orienting and placing apparatus according to the present invention.
Figure 2:
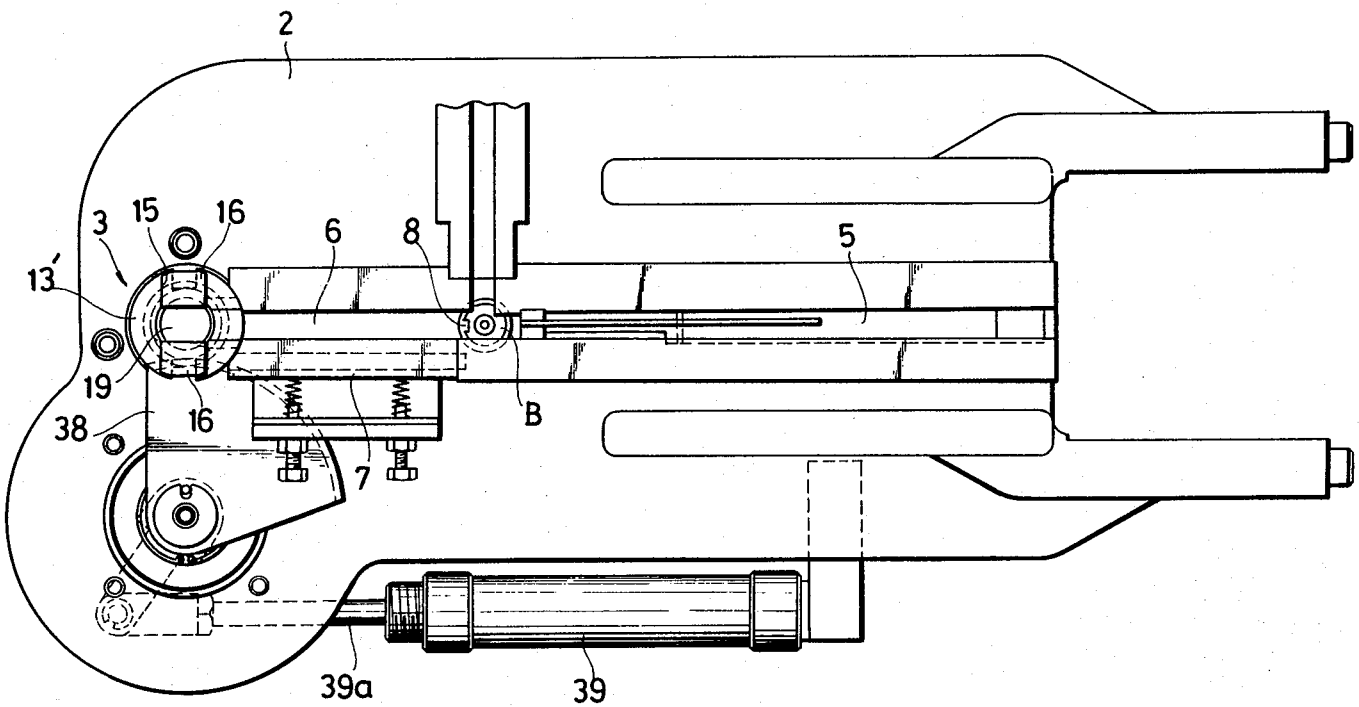
FIG. 2 is a fragmentary plan view of the apparatus of FIG. 1.

As shown in FIGS. 1 and 2, a button orienting and placing apparatus generally comprises an elongate horizontal guide 1 mounted on a support 2 for guiding buttons B (only one shown in FIG. 2 for clarity) one at a time from a vertical chute 4 into a clinching unit 3 (described below) disposed contiguous to one end of the guide 1, and a pusher 5 slidably supported on the guide 1 for pushing the button B out of the guide 1 into the clinching unit 3.

The guide 1 includes an elongate base, and a pair of first and second side walls disposed remotely from the clinching unit 3 and jointly defining between the first and second walls a first guide channel. The guide 1 also includes a third wall disposed adjacent to the clinching unit 3, and a friction member 7 disposed oppositely to the third side wall so as to define therewith a second guide channel 6 (FIG. 1) as an extension of the first guide channel. The first and third (upper in FIG. 2) side walls are longitudinally spaced apart from one another to provide therebetween an inlet port to which a lower end of the chute 4 is connected. Thus one button B having been discharged from the chute 4 is introduced into the second guide channel via the inlet port.

The button B (FIG. 2) has a disk-shaped head and a shank projecting centrally from the reverse side of the head. The head is covered over the obverse side by a decorative cap bearing a design, mark or symbol (not shown) indicative of a specified direction in which the button B is to be oriented when it is attached to a garment (not shown). The decorative cap has a rim portion extending around a peripheral edge of the head so as to define with the shank a ring-shaped shallow recess, there being a tab 8 projecting radially from the rim portion into the recess. The tab 8 is disposed at a predetermined position which corresponds to the specified direction of the non-illustrated design on the decorative cap.

The friction member 7 has a frictional surface frictionally engageable with the button head on its peripheral edge, i.e. on the rim portion of the decoration cap, for a purpose described below. The friction member 7 is pivotally mounted on a shaft supported by the guide base and is normally urged by a pair of compression springs (FIG. 2) to turn counterclockwise (as viewed from the left in FIGS. 1 and 2). Thus the frictional surface of the friction member 7 is urged against the rim portion of the decorative cap while the button B is moved through the second guide channel 6, as described below. The amount of biasing force of each compression spring may be adjusted by turning a screw.

As better shown in FIG. 2, the pusher 5 includes an elongate, button pushing slide slidably received in the combined guide channel of the guide 1, and a locking lever pivotally mounted on the slide. The slide has a stepped front end portion engageable at its tip end with the button head on its peripheral edge. The locking lever has a flanged front end portion extending beyond the stepped end portion of the slide and terminating in a pair of downwardly directed claws (not shown) for catching therebetween the tab 8 of the button B in a manner described below. A compression spring (not shown) is mounted between the slide and the locking lever to urge the latter to turn counterclockwise in FIG. 1; the flanged end portion of the locking lever is thus urged against the stepped end portion of the pushing slide. Such downward movement of the flanged end portion of the locking lever is restricted by the upper surface of the stepped end portion so as to prevent the button head from being excessively pressed and thus tilted by the flanged end portion. The pushing slide is operatively connected to a suitable drive means (not shown) for reciprocation through the combined (first and second) guide channel between a first position (FIGS. 1 and 2) in which both the pushing slide and the locking lever are retracted out of the second guide channel 6 into the unnumbered first guide channel for allowing the button B to be introduced into the second guide channel 6 from the chute 4 via the unnumbered inlet port, and a second position (not shown) in which both the pushing slide and the locking lever project through the second guide channel 6 for pushing the button B out of the second guide channel 6 into the clinching unit 3.

When the button B is pushed in the second guide channel 6 (FIG. 2) toward the clinching unit 3 by the tip end of the pushing slide, the button B turns counterclockwise in FIG. 2 because of the frictional surface of the friction member 7 until the tab 8 is caught by the pair of claws (not shown) of the locking lever. The pair of claws has a pair of convergent outer side surfaces (not shown), respectively, so that the tab 8 is received between the two claws in a snap action; one of the claws rides over the tab 8 against the biasing force of the non-illustrated compression spring mounted between the pushing slide and the locking lever, and the other claw blocks the tab 8. After having thus been caught, the button B slides rather than rolls on the frictional surface of the friction member 7.

With continued forward (leftward in FIGS. 1 and 2) movement of the pusher 5, the button B is pushed out of the second guide channel 6 into the clinching unit 3. As a result, the button B has been placed in the clinching unit 3 in a first direction.

The clinching unit 3 comprises a die 11 (FIG. 3) which coacts with a punch (not shown) to attach the button B to a garment (not shown) disposed between the die 11 and the punch as is well known in the art. The die 11 is secured at its lower end to a die holder 9 by means of a screw 12. The die holder 9, which is hollow at 10, is supported by the support 2. A finger holder 13 (FIGS. 1 and 3) is slidably and rotatably mounted on the die 11 and has on its periphery a gear 14. The finger holder 13 has at its upper end a flange 13' (FIG. 2) integral therewith. A pair of fingers 16,16 (FIGS. 1, 2 and 3) is pivotally mounted on the flange 13' by means of a pair of pins 17,17, respectively, and is fitted in a pair of grooves 15,15, respectively, of the flange 13'. Each of the fingers 16 has on its upper end an inwardly directed projection 16' (FIG. 3) having an inclined bottom surface 18. A recess 19 extends horizontally in an inner surface of each finger projection 16'. The two fingers 16,16 are normally urged toward one another by means of a spring 20 mound around the fingers 16,16. The finger holder 13 is normally urged upwardly by a compression spring 42.

Figure 4:
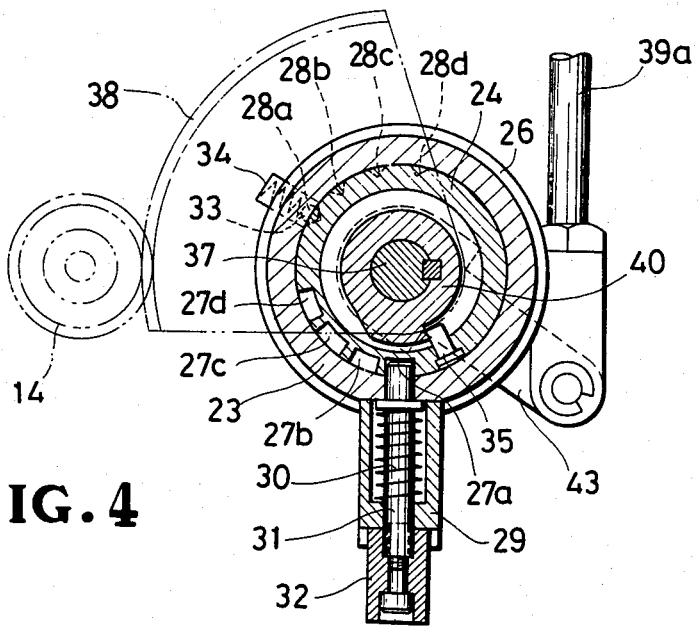
FIG. 4 is an enlarged cross-sectional view taken along line IV—IV of FIG. 3.
Figure 5:
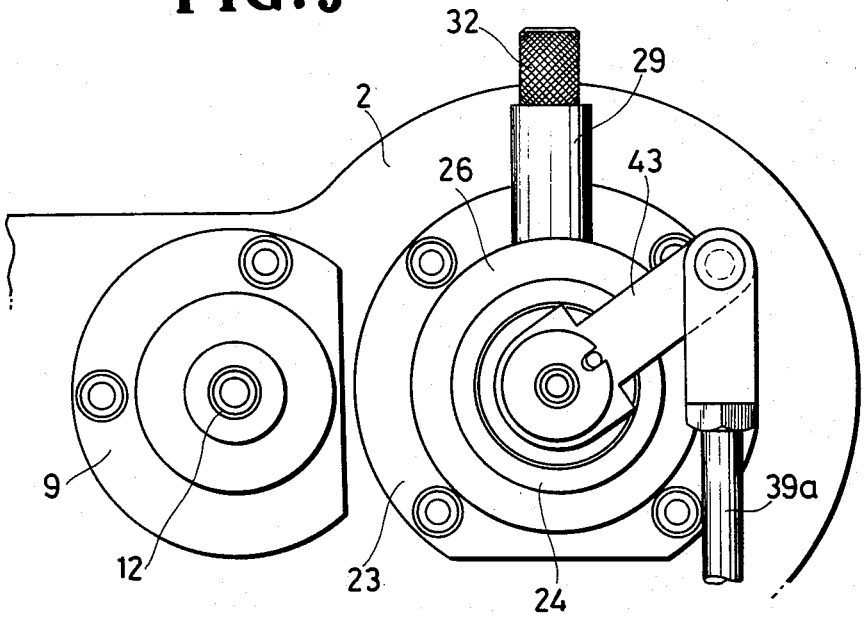
FIG. 5 is an enlarged, fragmentary bottom view of the apparatus.

The clinching unit 3 is operatively connected with a drive mechanism 21. The drive mechanism 21 includes an adjusting sleeve 24 rotatably received in a cylindrical holder 23 secured to the support 2 by a pair of screws 22,22. The sleeve 24 has at its upper end a flange 25. A ring 26 is secured to the lower end of the sleeve 24 to hold the holder 23 between the ring 26 and the flange 25, thus restricting the vertical movement of the holder 23. As shown in FIG. 4, the sleeve 24 has in its periphery a plurality of equidistantly spaced first recesses *27a,27b, 27c,27d*, and a plurality of second recesses *28a,28b,28c,28d* spaced apart from the first recesses *27a,27b,27c,27d* upwardly or downwardly, the distance between the second recesses being equal to the distance between the first recesses. A pin 31 is slidably inserted through a tube 29 secured to the holder 23, and is normally urged by a compression spring 30 toward the sleeve 24 so that the pin 31 is engageable with or projects into one of the first recesses *27a,27b,27c,27d* to lock the sleeve 24 with respect to the holder 23. The pin 31 can be retracted out of the recess by pulling a knob 32 (FIGS. 4 and 5) which is secured to the outer end of the pin 31, against the biasing force of the spring 30. A ball plunger 34 supported by the holder 23 includes a spring-biased ball 33 engageable with one of the second recesses *28a,28b,28c,28d* to thereby effect the positioning of the sleeve 24.

Figure 3:
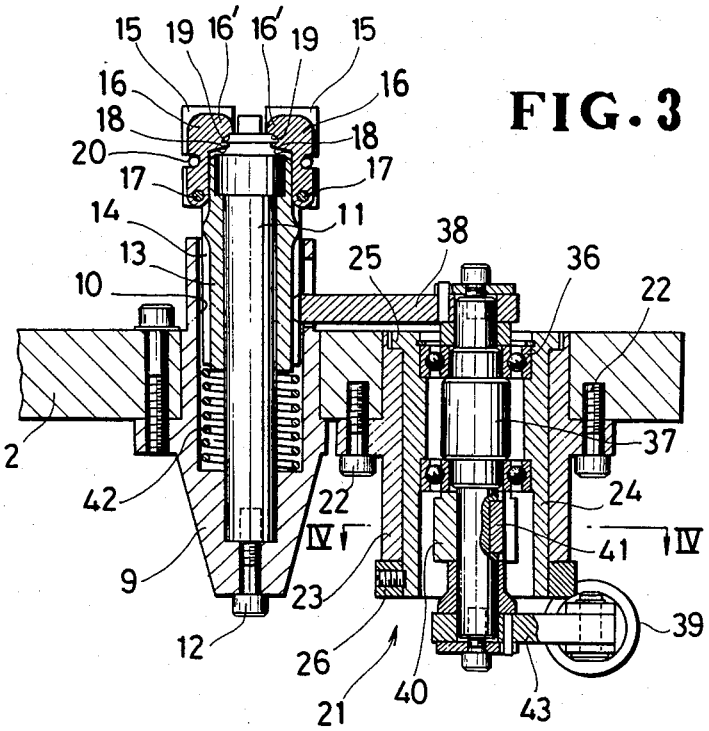
FIG. 3 is a cross-sectional view taken along line III—III of FIG. 1.

Inside the sleeve 24, a shaft 37 is mounted by means of bearings 36 (FIGS. 3). A sector gear 38 (FIGS. 1, 2, 3 and 4) is secured to the upper end of the shaft 37 and is in meshing engagement with the gear 14 of the finger holder 13. The lower end of the shaft 37 is connected to a lever 43 which is in turn connected to a piston rod **39*a* of an air-pressurized cylinder 39 mounted on the support 2. A cam plate 40 (FIGS. 3 and 4) is fixed to the shaft 37 by means of a key 41 and is engageable with a stop 35 (FIG. 4) carried by and projecting inwardly from the sleeve 24**.

When the button B is placed in the clinching unit 3 in the first direction (not shown) by the pusher 5 in the manner described above, the peripheral edge of the button head is fitted in the second grooves 19,19 of the fingers 16,16 and is thus clamped between the fingers 16,16. If it is unnecessary to change the direction of the button B in the clinching unit 3, the non-illustrated punch with a suitable mating fastener part (not shown) of a known construction is lowered to push the finger holder 13 downwardly so that the upper end of the die 11 strikes the fingers 16,16 on the inclined bottom surfaces 18,18, thus causing the fingers 16,16 to pivot in opposite directions away from one another. The button B is thereby allowed to fall on the die 11. With continued downward movement of the punch, the button B and its mating fastener part are clinched to couple together with a garment (not shown) placed between the die 11 and the punch. As a result, the button B has been attached on the garment in the first direction.

If it is necessary to change the direction of the button B in the clinching unit 3, the pin 31 is retracted out of one of the first recesses 27*a* by pulling the knob 32, and the sleeve 24 is then turned by hand to such an extent that the pin 31 is engageable with or project into the next first recess 27*b*. Thus the stop 35 has been angularly moved through 90°. When the piston rod 39*a* of the air-pressurized cylinder 39 is retracted, i.e. to the right in FIGS. 1 and 2, after the pusher 5 has been retracted away from the clinching unit 3, the shaft 37 and the cam plate 40 are turned counterclockwise in FIG. 4 through a predetermined angle until the cam plate 40 is stopped by the stop 35. This angular movement of the shaft 27 is transmitted to the finger holder 13 via the sector gear 38 and the gear 14, thus causing the button B to be turned through 90°. At that time the ball plunger 34 is in engagement with the second recess 28*b*.

Likewise, the pin 31 is brought into engagement with the recess 27*c* at which time the ball plunger 34 is in engagement with the recess 28*c*, in order to turn the button B in thc clinching unit 3 through 180°. If the pin 31 is brought into engagement with the recess 27*d*, at which time the ball plunger 34 is in engagement with the recess 28*d*, the button B will be turned through 270°.

The number of and the distance between the first recesses are not limited to the illustrated embodiment.

Alternatively, if a sector gear larger in radius is used, the distance between the first recesses may be smaller. Further, a circular gear may be used as a substitute for the sector gear.

The ball plunger 34 and the second recesses 28*a*,28*b*,28*c*,28*d* jointly serve to facilitate the positioning of the pin 31 with respect to the first recesses 27*a*,27*b*,27*c*,27 *d*.

With the apparatus thus constructed, it is possible to turn the finger holder 13, carrying the botton B, through a predetermined angle accurately by the action of the gears 14 and 38, thus causing precise orientation of the button B. Further, when the die 11 is impacted by the non-illustrated punch during the clinching operation, the two gears 14 and 38 vertically slide relatively to one another to absorb such impact, thus preventing the drive mechanism 21 from being influenced by the impact. Accordingly, smooth angular movement of the finger holder 13 is guaranteed.

Additionally, since the bottom B is held by the two fingers 16,16 while the button B is turned, accurate and stable orientation of the button B can be achieved.

Given that the sector gear 38 is larger in radius than the gear 14, only a short stroke of the air-pressurized cylinder is required to turn the button B through a particular angle. If a shorter lever 43 is used, it is also possible to use a shorter cylinder.

Although various minor modifications may be suggested by those versed in the art, it should be understood that I wish to embody within the scope of the patent warranted hereon, all such embodiments as resonably and properly come within the scope of my contribution to the art.

What is claimed is:

1. An apparatus for orienting and placing a button for attachment to a garment, comprising:
   (a) a support;
   (b) a guide mounted on said support and having a guide channel for guiding the button therethrough;
   (c) a pusher slidably mounted in said guide for pushing the button through and out of said guide channel;
   (d) a clinching die fixed to said support contiguous to one end of said guide for receiving thereon the button having been pushed out of said guide channel;
   (e) a finger holder axially slidably and rotatably mounted on said clinching die and having at its upper end a pair of fingers for clamping the button on said clinching die, said finger holder having on its periphery a first gear;
   (f) a second gear carried by said support and meshing with said first gear;
   (g) a cylindrical holder secured to said support;
   (h) an adjusting sleeve rotatably mounted in said cylindrical holder so as to be movable axially of said cylindrical holder to a limited extent;
   (i) a shaft rotatably mounted inside said sleeve, said second gear being secured to said shaft;
   (j) a fluid-pressurized cylinder operatively connected with said second gear for turning the latter through a predetermined angle; and
   (k) means for adjustably regulating the extent to which said second gear is turned, said regulating means comprising a plurality of equidistantly spaced first recesses in a periphery of said sleeve, and a pin carried by said cylindrical holder and releaseably engageable with one of said first recesses which is chosen depending on the extent to which the button is to be turned.

2. An apparatus according to claim 1, including a spring normally urging said finger holder upwardly.

3. An apparatus according to claim 1, said pair of fingers being pivotally mounted on said finger holder and being spring-biased toward one another.

4. An apparatus according to claim 3, each of said fingers having an inwardly directed projection having an inclined bottom surface which is engageable with an upper end of said clinching die, when said finger holder is lowered relatively to said clinching die, to cause said pair of fingers to pivot so as to release the button.

5. An apparatus according to claim 1, further including a spring normally urging said pin radially inwardly, and a knob mounted on outer end of said pin for pulling said pin radially outwardly to retract the latter out of said one of said first recesses, said sleeve being thereby allowed to turn for angular adjustment with respect to said cylinder holder.

6. An apparatus according to claim 5, further including a cam plate fixed to said shaft, and a stop carried by and projecting radially inwardly from said sleeve for engagement with said cam plate to thereby restrict the extent to which said sleeve is angularly moved with respect to said shaft.

* * * * *